US005885682A

United States Patent [19]

Tanimoto et al.

[11] Patent Number: 5,885,682

[45] Date of Patent: Mar. 23, 1999

[54] VACUUM HEAT INSULATION PANEL

[75] Inventors: Yasuaki Tanimoto, Nishinomiya; Noriyuki Miyaji, Itami, both of Japan

[73] Assignee: Matsushita Refrigeration Company, Osaka-Fu, Japan

[21] Appl. No.: 106,301

[22] Filed: Jun. 29, 1998

Related U.S. Application Data

[63] Continuation of Ser. No. 828,615, Jan. 31, 1997, abandoned, which is a continuation of Ser. No. 565,482, Nov. 30, 1995, abandoned.

[30] Foreign Application Priority Data

Dec. 2, 1994 [JP] Japan ..... 6-299477

[51] Int. Cl.[6] ..... B32B 1/06

[52] U.S. Cl. ..... 428/69; 428/71; 252/181.1; 252/181.7

[58] Field of Search ..... 428/69, 71, 76, 428/403, 404; 445/55; 252/181.1, 181.7

[56] References Cited

U.S. PATENT DOCUMENTS

| | | | |
|---|---|---|---|
| 2,768,046 | 10/1956 | Evans | 312/214 |
| 3,114,469 | 12/1963 | Francis et al. | 220/9 |
| 4,668,555 | 5/1987 | Uekado et al. | 428/69 |
| 4,745,015 | 5/1988 | Cheng et al. | 428/35 |
| 5,018,328 | 5/1991 | Cur et al. | 52/406 |
| 5,273,801 | 12/1993 | Barry et al | 428/69 |
| 5,312,606 | 5/1994 | Boffito et al. | 423/210 |
| 5,408,832 | 4/1995 | Boffito et al. | 62/451 |

FOREIGN PATENT DOCUMENTS

| | | |
|---|---|---|
| 63-003166 | 1/1988 | Japan . |
| 7-063469 | 3/1995 | Japan . |
| WO 93/25842 | 12/1993 | WIPO . |
| WO 93/25843 | 12/1993 | WIPO . |
| WO 94/25697 | 11/1994 | WIPO . |
| WO 95/16166 | 6/1995 | WIPO . |
| WO 96/01966 | 1/1996 | WIPO . |

*Primary Examiner*—Alexander Thomas
*Attorney, Agent, or Firm*—Panitch Schwarze Jacobs & Nadel, P.C.

[57] ABSTRACT

A vacuum heat insulation panel for refrigerators and freezers comprises a thin-box shaped enclosure (4) for controlling permeation of the open air, and therein a core member (2) with thermal insulating properties and a barium-lithium alloy getter (3) which has long life time as getter.

6 Claims, 5 Drawing Sheets

VACUUM HEAT INSULATION PANEL

CROSS REFERENCE TO RELATED APPLICATION

This application is a continuation of application Ser. No. 08/828,615, filed Jan. 31, 1997, abandoned which, in turn, is a continuation of application Ser. No. 08/565,482, filed Nov. 30, 1995, abandoned, both entitled "VACUUM HEAT INSULATION PANEL," the entire disclosures of both being incorporated herein by reference.

FIELD OF THE INVENTION AND RELATED ART STATEMENT

1. Field of the Invention

The present invention relates to a vacuum heat insulation panel usable as thermal insulators or thermal insulation bodies for refrigerators or the like.

2. Description of the Related Art

The threat to the ozone layer of a chlorofluorocarbon CFC-11, which has been used as a foaming agent of thermal insulators for walls and doors of refrigerators and freezers, has been noted as a global environmental problem.

In such circumstances, thermal insulators are extensively studied to utilize chlorofluorocarbon-replacing, novel foaming agents of alternative fluorocarbon material or non fluorocarbon-containing material. A known example of the alternative fluorocarbon material is HCFC-141b, and that of the non-fluorocarbon-containing material is cyclopentane.

These novel foaming agents, however, have higher thermal conductivity than that of the conventional CFC-11, and hence inevitably lower the thermal insulating properties in refrigerators.

Improvement in thermal insulating properties is, on the other hand, one of the important issues to realize the energy-saving measures including energy conservation in refrigerators. Refrigerators and freezers accordingly face the conflicting problems, that is, the lowered thermal insulating properties due to use of the chlorofluorocarbon-replacing substance and the required improvement in better thermal insulating properties for achievement of higher energy conservation.

A prior art, JAPANESE PATENT unexamined published application No. 6-11247, proposed for solving these conflicting problems discloses a vacuum heat insulation panel using an adsorbent mainly composed of an alumina compound with carbonate ions included in molecular structure.

The prior art technique provides the vacuum heat insulation panel by filling an outer or coating member with a core member, such as rigid urethane foam of open-cell structure or a powdery substance like perlite, and an adsorbent mainly composed of an alumina compound with carbonate ions arranged in its molecular structure, and sealing the core member inside under reduced pressure.

The adsorbent used in the prior art is an alumina compound with carbonate ions arranged in its molecular structure, thereby having a high selective adsorption capacity for carbon dioxide and being capable of maintaining a very low pressure of carbonate gas over a long time period.

The insulating principle of vacuum heat insulation panels is to eliminate a heat-conducting gas, for example, the air, from a relatively thin box-like structure of the refrigerator or freezer, such as doors and walls. It is, however, rather difficult to realize a high degree of vacuum on the industrial level, and the practically attainable degree of vacuum has been 0.1 to 10 torr. Therefore, it is required to attain a desired thermal insulating property under such a relatively low degree of vacuum.

Mean free path of gas molecules is an important physical property which affects the thermal insulating properties in the process of heat conduction via the air or another gas. The mean free path denotes a distance which one constituent molecule of gas, e.g., air travels before colliding with another molecule. When a void of space formed in the vacuum heat insulation panel is greater than the mean free path, molecules collide with one another in the void of space so as to cause heat conduction via the gas, thus increasing the thermal conductivity of the vacuum heat insulation panel. The void smaller than the mean free path decreases the thermal conductivity of the vacuum heat insulation panel, on the contrary. This is ascribed to little heat conduction due to the collision of constituent molecules of the gas, e.g., air.

In order to maintain the performance of the vacuum heat insulation panel over a long time period, it is required to keep the mean free path of the gas or air at a relatively large constant value. Accordingly, the high degree of vacuum kept over a long time period is important. This requires adsorption and removal of a gas evolved from the core member and any gas permeating and invading the vacuum heat insulation panel. It is only the case of organic material that the core members evolve gas, and the evolved gas is mostly carbon dioxide. A variety of gases, which permeate the vacuum heat insulation panel from outside are such as nitrogen, oxygen, and carbon dioxide.

It is required to adsorb and remove nitrogen and oxygen simultaneously with removal of carbon dioxide in order to keep the degree of vacuum of the vacuum heat insulation panel at a relatively high constant value and maintain the thermal insulating properties thereof over a long time period.

The prior art described above, however, uses an adsorbent effective only for carbon dioxide, which decreases the degree of vacuum and worsens the thermal insulating properties of the vacuum heat insulation panel when nitrogen and oxygen molecules directly permeate and permeate the vacuum heat insulation panel.

A barium getter and a zirconium-vanadium-iron three-way alloy getter have adsorption capacity for oxygen and nitrogen. Both are widely known; the former is typically used for vacuum tubes and the latter for vacuum bottles.

The barium getter is an evaporating type getter, which needs heating to high temperatures in a vacuum atmosphere and is thus not applicable for vacuum heat insulation panels using plastics. The zirconium-vanadium-iron alloy getter is inert at ordinary temperature and requires activation at temperatures of no lower than 450° C. Activation at high temperatures over 450° C. in the atmosphere results in adsorption of gas molecules included in the atmosphere, and activation in the vacuum atmosphere is thus preferable. This shows that neither of the above-mentioned getters is not suitable for vacuum heat insulation panels using plastics. It is therefore difficult to maintain the thermal insulating properties of vacuum heat insulation panels using plastics.

Solving such problems is an essential subject to be dissolved for the improvement in performance of the vacuum heat insulation panel using plastics.

OBJECT AND SUMMARY OF THE INVENTION

An object of the present invention is to provide a vacuum heat insulation panel using plastics which maintains thermal insulating properties over a long time period.

A vacuum heat insulation panel in accordance with the present invention comprises an outer member for controlling permeation of the open air, a core member defining a shape and having thermal insulating properties, and a non-evaporating type getter.

The non-evaporating type getter does not need heating or evaporating in the vacuum atmosphere in the process of manufacturing the vacuum heat insulation panel, but permits treatment at ordinary temperature. This getter is applicable to the vacuum heat insulation panel using plastics as an outer member, and allows the thermal insulating properties of the vacuum heat insulation panel to be kept over a long time period.

A vacuum heat insulation panel in accordance with a mode of the present invention is that the non-evaporating type getter is an alloy containing barium and lithium.

By using as the non-evaporating type getter an alloy containing barium and lithium, the adsorption capacity at ordinary temperature improves remarkably. Barium and lithium have a strong affinity for oxygen, nitrogen, carbon dioxide, water, and the like and accordingly exert the high adsorption for these gaseous substances. An important fact is that a simple substance of barium or lithium easily falls in a passivity state by the formation of barium nitride, lithium nitride, barium oxide, and lithium oxide on the surface thereof, and can thus adsorb only a very small amount of gas molecules. In order to eliminate such a drawback, the present inventors used an alloy getter prepared by adding lithium to the host material, barium, thereby forming crystalline structure of hexagonal close-packed lattice and a bulk. The preferable range of barium content is 83 to 98% by weight, although compositions containing 62 to 83% by weight of barium may also be applicable. Nitrogen and oxygen adsorbed by the alloy getter containing barium and lithium temporarily form a nitrogen layer and an oxygen layer on the surface of the getter, respectively. The crystalline structure of hexagonal close-packed lattice formed by the barium-lithium alloy allows nitrogen and oxygen molecules to diffuse and penetrate inside the crystalline structure. The passivity coat of nitrogen layer and oxygen layer formed on the surface of the getter disappears with time, and the purified surface of the getter maintains a high adsorption over a long time period. Application of this getter realizes the long-term maintenance of desired performance.

According to another mode of the invention, the surface of the non-evaporating type getter is covered with a coat layer of a water adsorbent.

In the present invention, by coating the surface of the barium and lithium-containing alloy getter with a water adsorbent, a problem of lowering of adsorption of the getter owing to adsorption of the water content included in the atmosphere is solved.

It is preferable that the water adsorbent is laid or laminated over the barium-lithium alloy. One concrete example of preferable process is such that lead oxide powder working as a water adsorbent is laminated over the barium-lithium alloy. The preferable average particle diameter of the lead oxide powder is 2 to 12 $\mu$m, although powder up to 90 $\mu$m in average particle diameter exerts some effects. The suitable porosity of the water adsorbent ranges from 60 to 95%.

The greater thickness of the water adsorbent laid over the alloy relieves the influence of water adsorption to the greater extent; but the relieving effect does not change for the thickness of 10 mm or greater.

Although lead oxide is preferably used as a water adsorbent, barium oxide and magnesium oxide also have similar effects.

The getter covered with the water adsorbent is free from the adverse effect of treatment in the atmosphere and allows the performance of the vacuum heat insulation panel to be maintained over a long time period.

According to another mode of the invention, the non-evaporating type getter is a powdery form.

By the use of the powdery barium and lithium-containing alloy getter with its surface covered with a water adsorbent, adjustment of the adsorption rate is easy; and selection of the getter corresponding to the gas permeation ability of the outer member is possible. This makes the adsorption load of the getter substantially constant and improves the reliability on the performance of the vacuum heat insulation panel.

According to another mode of the invention, a foamed heat insulator and a vacuum heat insulation panel in accordance with claim 1 is arranged in a space of this the box-like member to insulate heat.

Since the vacuum heat insulation panel of the present invention uses an adsorbent including at least a non-evaporating type getter, treatment at ordinary temperature and atmospheric pressure is possible, and the invention is applicable to plastic vacuum heat insulation panel that can not be heated to high temperatures.

The vacuum heat insulation panel of the present invention uses a barium and lithium-containing alloy as the non-evaporating type getter, which prevents the formation of a passivity coat on the surface of the getter, thereby maintaining the high adsorption capacity over a long time period and preventing the performance of the vacuum heat insulation panel from being undesirably lowered.

By covering the surface of the barium and lithium-containing alloy getter with a water adsorbent, even though exposed to air for a short time, the alloy getter does not deteriorate. Thereby it is easily treated and the performance of the vacuum heat insulation panel is maintained over a long time period.

The vacuum heat insulation panel of the present invention which uses the powdery barium and lithium-containing alloy getter with its surface covered with a water adsorbent, adjustment of the adsorption rate is easy, and selection of the getter corresponding to the gas permeability of the outer member is easy. Resultantly, the adsorption load of the getter is substantially constant, thereby improving the reliability on the performance of the vacuum heat insulation panel.

Since a heat insulating box-like member of the present invention uses the vacuum heat insulation panel to which the barium and lithium-containing alloy getter is applied, this structure solves the problems of the excessive operating efficiency of compressors in refrigerators and freezers and the lowered quality due to the deteriorating performance of the vacuum heat insulation panel within a short time period is prevented.

BRIEF DESCRIPTION OF THE DRAWINGS

Although the scope and spirit of the present invention are only limited by the terms of the appended claims, the above-mentioned and other related objects, features, aspects, and advantages of the present invention will be fully understood and appreciated from the following detailed description with the accompanying drawings.

Figure 1:
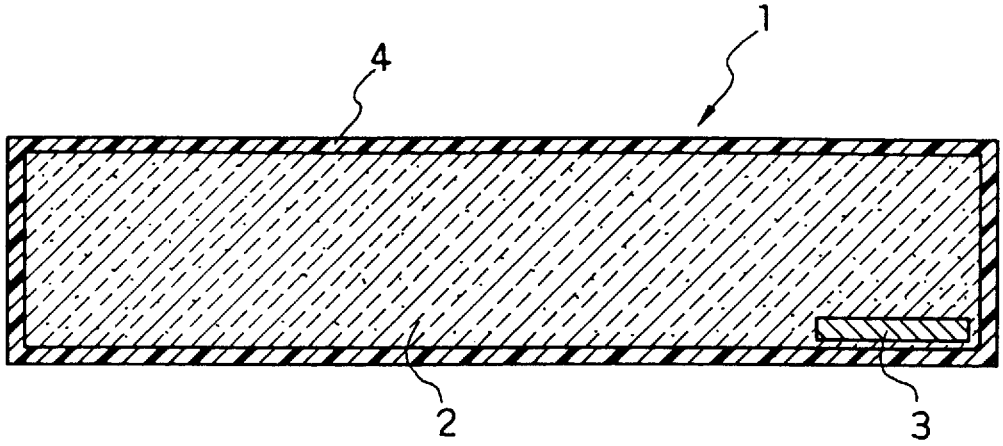
FIG.1 is a cross-sectional view illustrating a vacuum heat insulation panel embodying the present invention.

It should be noted that part of or all the drawings are illustrated for the purpose of schematic expression and do not always represent the relative sizes and positions of the constituents illustrated therein faithfully.

DESCRIPTION OF THE PREFERRED EMBODIMENT

One embodiment of the present invention is described with reference to the accompanying drawings of FIGS. 1, 2, 3, 4, and 5.

In the drawings, a vacuum heat insulation panel 1 is prepared by: filling an outer member 4 made of a metal-plastics laminate film with a core member 2 including rigid urethane foam of open-cell structure dried at 150° C. for 1 hour and having dimensions of 100 cm×50 cm×3 cm and a porosity of 60 to 99% and a getter 3 including a barium and lithium-containing alloy having a size of 60 mm in diameter×3 mm in thickness, and sealing the outer member 4 under a reduced pressure of 0.1 torr attained by a vacuum pump. The metal-plastics laminate film includes a polyethylene-terephthalate resin film of 10 μm thickness as an outer-most layer, an ethylene-vinyl alcohol copolymer resin film of 20 μm thickness metallized with aluminum of 500 Å as an inner layer, and a high-density polyethylene resin film of 50 μm in thickness as an inner-most layer, which are integrally formed and joined with one another. It is preferable that a water adsorbent is laid over the surface of the barium and lithium-containing alloy getter 3. One concrete preferable example of procedures lays lead oxide powder to work as a water adsorbent onto the barium-lithium alloy getter 3. The lead oxide powder used had the average particle diameter of 7 μm. The preferable average particle diameter of the lead oxide powder is 2 to 12 μm, although powder up to 90 μm in average particle diameter exerted some effects. The greater thickness of the water adsorbent laid over the alloy relieves the adverse effect of water adsorption to the greater extent; but the relieving effect does not change for the thickness of not less than 10 mm. Other than lead oxide, such water adsorbents as barium oxide and magnesium oxide exert similar effects. The porosity of the water adsorbent layer was about 90%.

EXAMPLE 1

Figure 2:
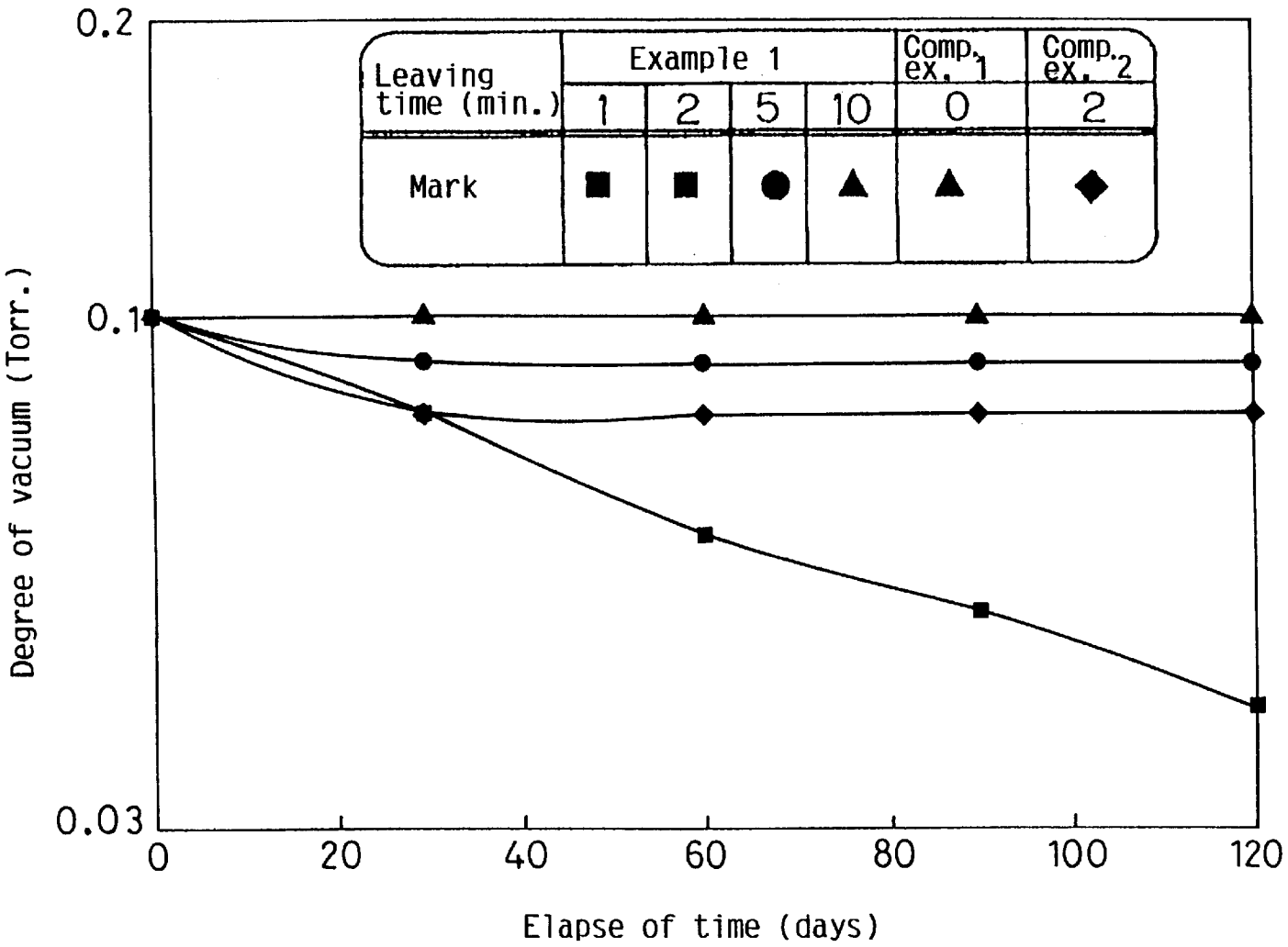
FIG.2 is a characteristic chart showing the relationship between the elapse of time (days) and the internal pressure in one example of the present invention.

Table 1 and FIG.2 show a change in degree of vacuum in the vacuum heat insulation panel obtained as stated above, with a lapse of time (days).

TABLE 1

| | Example | | | | Comparison examples | |
|---|---|---|---|---|---|---|
| | Example 1 | | | | Comparis. ex. 1 | Comparis. ex. 2 |
| | Leaving time | | | | | |
| Elapse of days | 1 min. | 2 min. | 5 min. | 10 min. | 0 min. | 2 min. |
| Initial stage | 0.1 | 0.1 | 0.1 | 0.1 | 0.1 | 0.1 |
| 30 days | 0.08 | 0.08 | 0.09 | 0.1 | 0.1 | 0.08 |
| 60 days | 0.06 | 0.06 | 0.09 | 0.1 | 0.1 | 0.08 |
| 90 days | 0.05 | 0.05 | 0.09 | 0.1 | 0.1 | 0.08 |
| 120 days | 0.04 | 0.04 | 0.09 | 0.1 | 0.1 | 0.08 |

Unit: torr

The vacuum heat insulation panel of comparison example 1 (Comparis. 1 in the Table and Figure) is made without using a getter. This does not show a pressure variation. This means that no gas is evolved from the core member or permeates or permeates into through the outer member.

Comparison example 2 (Comparis. 2 in the Table and Figure) utilizes simple substance of barium as a getter. This getter has a low adsorption capacity and loses its adsorption capacity when exposed to the air even for a short time period. As clearly shown in Table 1 and FIG. 2, exposure of the getter to the atmosphere for only 2 minutes prior to the sealing in the outer member results in substantially no adsorption capacity of the getter.

On the other hand, the embodiments using the barium and lithium-containing alloy getters of Example 1 according to the present invention adsorbed oxygen and nitrogen at ordinary temperature, although the degrees of adsorptions varied with the leaving time, that is, the periods for which the getters have been left in the atmosphere prior to each sealing in the outer member. Since the surfaces of the getters in this example are not covered with a water adsorbent, the adsorption capacities drastically decreased in the cases the getters were left in the atmosphere for 5 minutes or longer;, but in the cases of exposures to the atmosphere were within 2 minutes did not cause any problem. The examples clearly remarkable technical advantages of using the getter alloy containing both barium and lithium.

EXAMPLE 2

Figure 3:
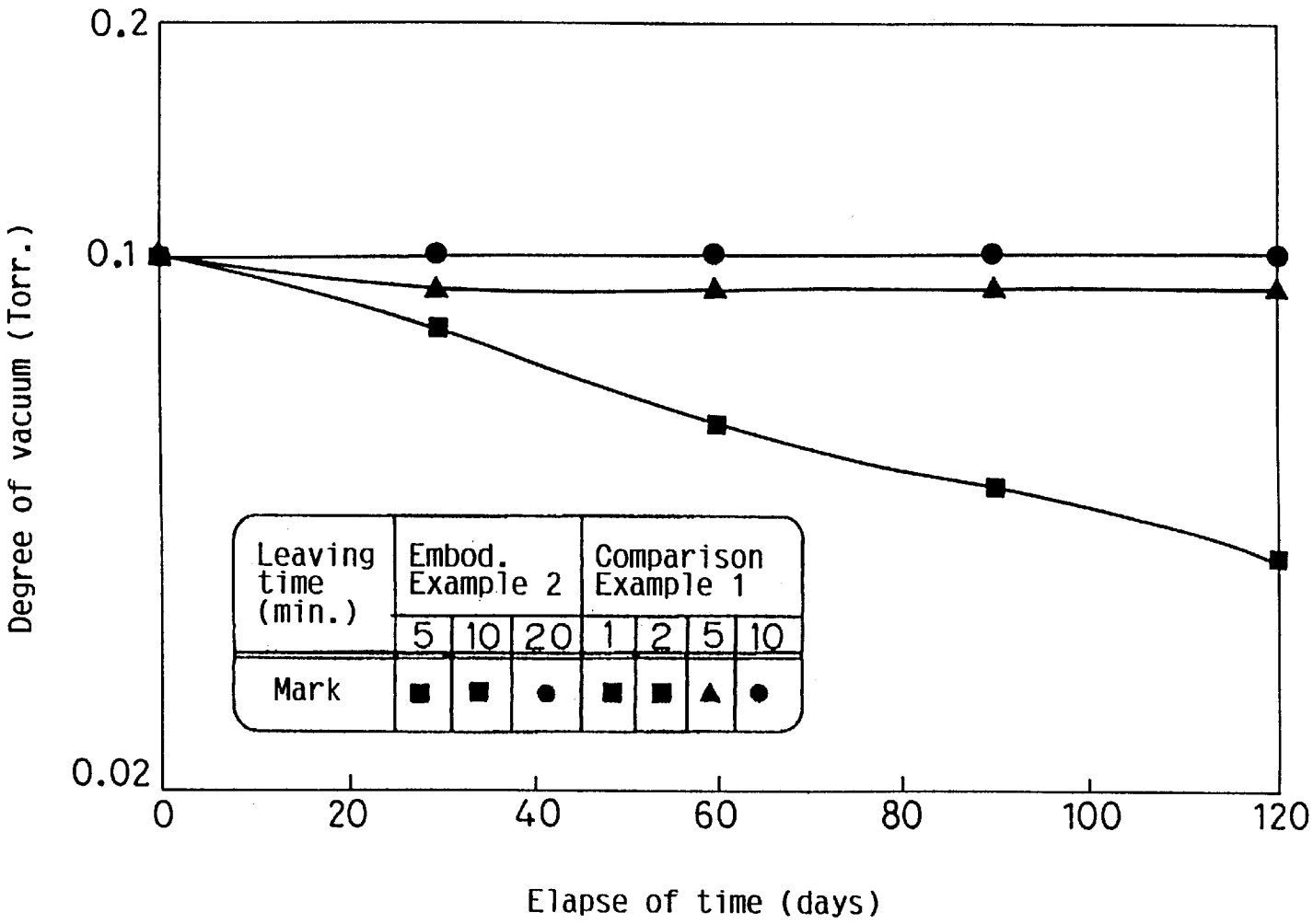
FIG.3 is a characteristic chart showing the relationship between the elapse of time (days) and the internal pressure in another example of the present invention.

Table 2 and FIG. 3 show the results when the surfaces of the barium and lithium-containing alloy getters 3 are covered with barium oxide as water adsorbent film.

TABLE 2

| | Example Example 2 | | | Comparison example Example 1 | | | |
|---|---|---|---|---|---|---|---|
| | Leaving time (min.) | | | | | | |
| Elapse of days | 5 | 10 | 20 | 1 | 2 | 5 | 10 |
| Initial stage | 0.1 | 0.1 | 0.1 | 0.1 | 0.1 | 0.1 | 0.1 |
| 30 days | 0.08 | 0.08 | 0.1 | 0.08 | 0.08 | 0.09 | 0.1 |
| 60 days | 0.06 | 0.06 | 0.1 | 0.06 | 0.06 | 0.09 | 0.1 |
| 90 days | 0.05 | 0.05 | 0.1 | 0.05 | 0.05 | 0.09 | 0.1 |
| 120 days | 0.04 | 0.04 | 0.1 | 0.04 | 0.04 | 0.09 | 0.1 |

Unit: torr

Example 2 has the possible leaving time or possible period of exposure to the atmosphere 5 times longer than that of Example 1; and no problem arises even when the getters are left in the atmosphere for 10 minutes. This is, as a result of covering the getters 3 with the water adsorbent films to prevent the activity of the getter from being undesirably lowered, longer possible times of exposure to the atmosphere are attained, thereby significantly improve the working properties. The results also allow the satisfactory performance of the vacuum heat insulation panel to be kept for a longer service time period.

EXAMPLE 3

Figure 4:
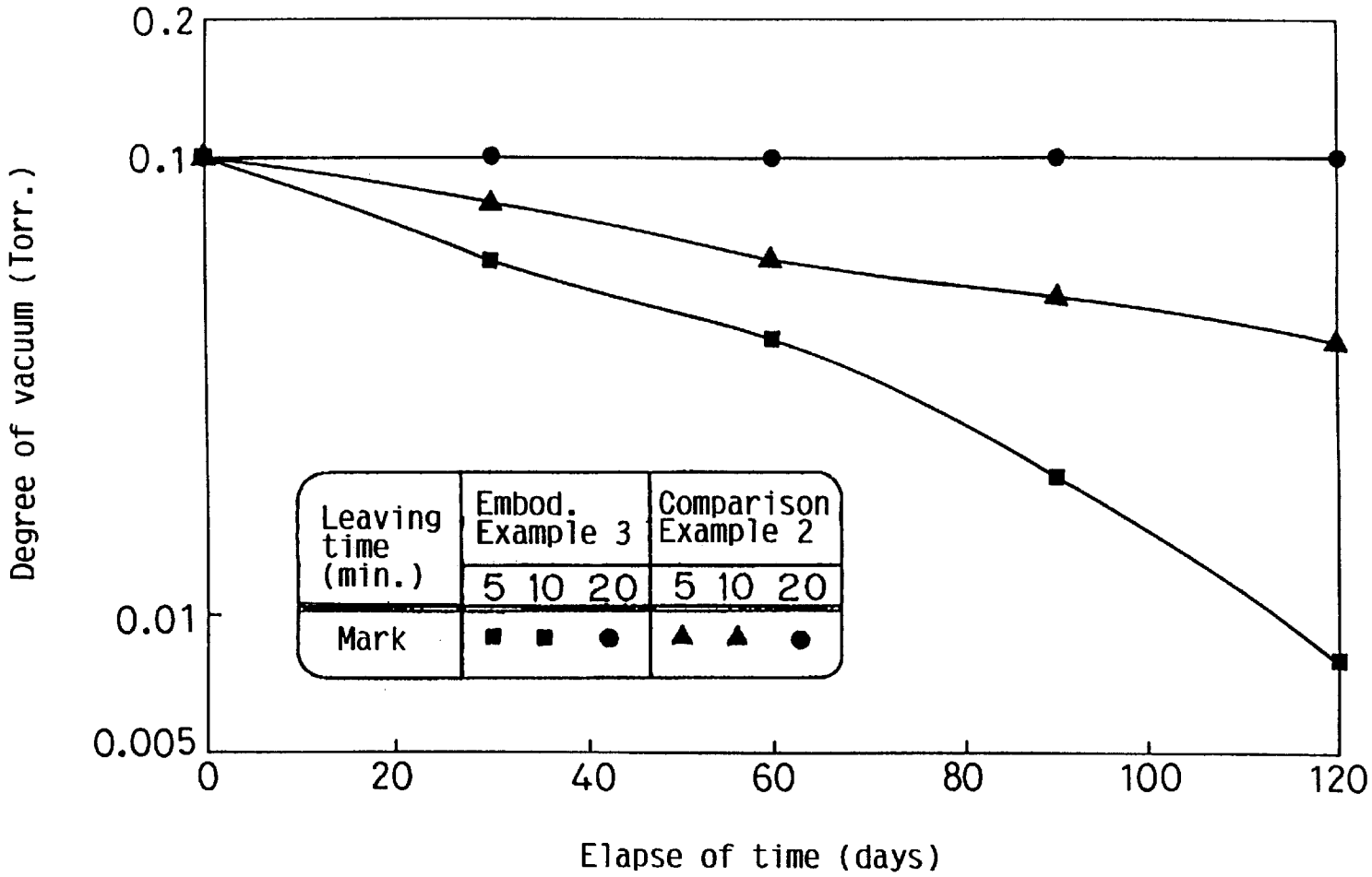
FIG.4 is a characteristic chart showing the relationship between the elapse of time (days) and the internal pressure in still another example of the present invention.

Table 3 and FIG. 4 show the results when the barium and lithium-containing getter alloy is powdered into particles of about 5 $\mu$m diameter and filled with a thickness of about 3 mm as getter 3 in an aluminum container of about 60 mm diameter and 4 mm depth, whereon powder of barium oxide of about 5 $\mu$m diameter particles are put laminating forming a layer of about 1 mm thickness as water adsorbent, and a gas-passing web is put thereon as a cover.

TABLE 3

| | Example Example 3 | | | Comparison example Example 2 | | |
|---|---|---|---|---|---|---|
| | Leaving time (min.) | | | | | |
| Elapse of days | 5 | 10 | 20 | 5 | 10 | 20 |
| Initial stage | 0.1 | 0.1 | 0.1 | 0.1 | 0.1 | 0.1 |
| 30 days | 0.06 | 0.06 | 0.1 | 0.08 | 0.08 | 0.1 |
| 60 days | 0.04 | 0.04 | 0.1 | 0.06 | 0.06 | 0.1 |
| 90 days | 0.02 | 0.02 | 0.1 | 0.05 | 0.05 | 0.1 |
| 120 days | 0.008 | 0.008 | 0.1 | 0.04 | 0.04 | 0.1 |

Unit: torr

The particles of Example 3 showed a greater adsorption rate as getter than that of bulk form shown in Example 2. The reason is considered such that the powdery configuration increases the specific surface area of the getter. Selection of the particle diameter of the powder allows adjustment of the adsorption rate suited to the gas permeation ability of the outer member. As a result, the adsorption load of the getter is made substantially constant and improves the reliability on the performance of the vacuum heat insulation panel and panel.

Besides, the barium-lithium binary alloy, addition of a third metal such as magnesium or strontium to the barium-lithium alloy gives the similar effect.

Since magnesium or strontium has a relatively low reaction activity, by adding these to the barium-lithium alloy a getter having greater stability is obtainable. Particularly, the preferable content of magnesium is 0.2 to 0.8% by weight, and the addition of magnesium in this range gives a highly stable getter without adversely affecting the adsorption capacity.

Since strontium has an equivalent reaction activity to that of magnesium, its preferable content is 0.2 to 0.8% by weight.

For the purpose of improving the adsorption capacity with respect to carbon dioxide and water, a carbon dioxide adsorbent, a water adsorbent, and active carbon may be combined with the barium-lithium alloy getter. Preferable examples of the carbon dioxide adsorbent include calcium hydroxide and zeolite with the average particle diameter of 5 to 20 $\mu$m and active carbon powder with the average particle diameter of 0.8 to 6 $\mu$m. As the water adsorbent, preferably calcium chloride powder, or more preferably calcium chloride powder with the average particle diameter of 2 to 18 $\mu$m may be used.

It is preferable that the barium-lithium getter is covered with a non-woven fabric, which is impregnated with 25 g carbon dioxide adsorbent and with approximately 15 g water adsorbent independently or in combination.

The getter of the present invention permits treatment under the atmospheric pressure and allows the performance of the vacuum heat insulation panel to be kept over a long time period.

EXAMPLE 4

Figure 5:
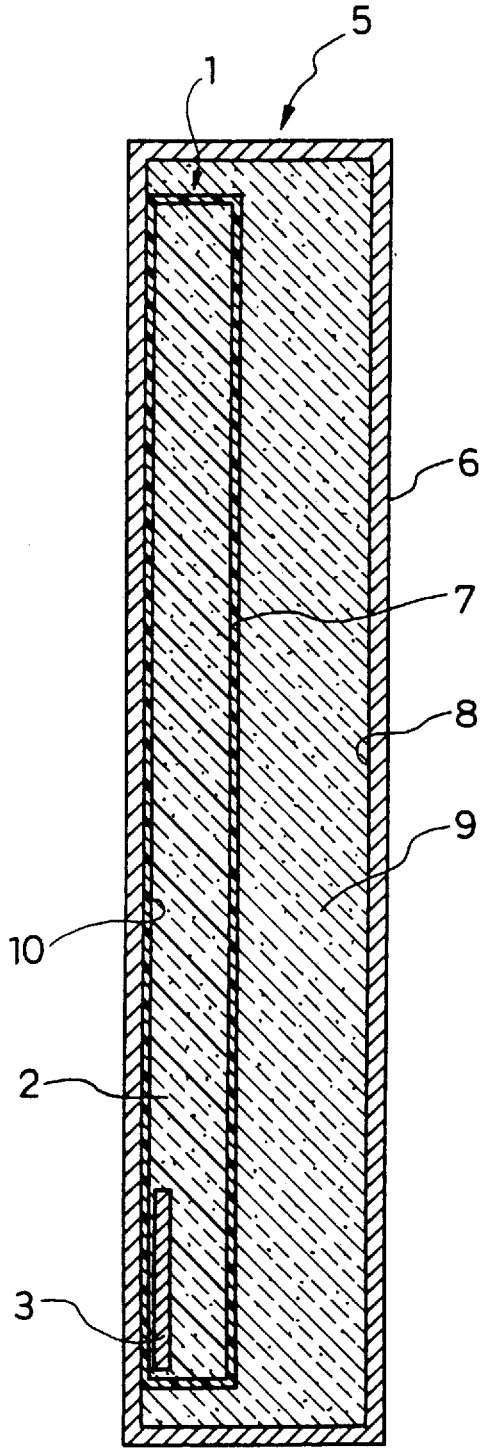
FIG.5 is a cross sectional view illustrating a heat insulation box-like panel as another embodiment of the present invention.

FIG. 5 gives an example of heat insulating panel or box-like members of small thickness (thin) applicable as structural members of walls and doors of refrigerators, freezers, and the like. In the drawing of FIG. 5, a heat insulating box-like member 5 comprises a foamed heat insulator 9 and a vacuum heat insulation panel 1 which are laid laminating in a first space 8 defined by an outer box 6 and a second space 10 defined by an inner box 7, respectively. Although the vacuum heat insulation panel 1 is disposed in the inner box 7 in this example, alternatively it may be provided in the outer box 6 as a modified example.

Since the heat insulating thin box-like member or panel thus constructed includes a barium-and-lithium-containing alloy getter 3 attached to the vacuum heat insulation panel 1, nitrogen and oxygen atoms invading from outside space are adsorbed and removed. Therefore the heat insulation panels of the invention solve the problems of the excessive operating rate of compressors in the refrigerators and freezers and the excessive power consumption due to the deteriorating performance of the heat insulation panel within a relatively short time period.

Although the invention is described in some detail according to the preferred examples thereof, the disclosure of the preferred examples may be changed and modified in many ways, and it is clearly understood that the combination and arrangement of the constituents may be changed without departing from the scope and spirit of the claimed invention.

What is claimed is:

1. A vacuum heat insulation panel comprising an enclosing member for controlling permeation of the open air, a core member defining a shape and having thermal insulating properties and contained in said enclosing member, and a non-evaporating getter contained in said enclosing member, said non-evaporating getter being of a powdery form having powders, each of which is covered with a coat layer of a water-adsorbent.

2. A vacuum heat insulation panel in accordance with claim 1, wherein said non-evaporating getter is an alloy containing barium and lithium.

3. A vacuum heat insulation panel comprising:

an enclosing member for controlling permeation of the open air, a core member defining a shape and having thermal insulating properties, and a non-evaporating getter which is of a powdery form having powders each of which is covered with a coat layer of a water adsorbent.

4. A vacuum heat insulation panel comprising an enclosing member for controlling permeation of the open air, a core member defining a shape and having thermal insulating properties and contained in said enclosing member, and a non-evaporating getter which is an alloy containing barium and lithium, and which is contained in said enclosing member, wherein the surface of said non-evaporating getter is of a powdery form having powders, each of which is covered with a coat layer of a water adsorbent.

5. A heat insulating thin box-like member comprising:

a thin box to insulate heat, a foamed heat insulator and a vacuum heat insulation panel contained in a space of said thin box to insulate heat, and said vacuum heat insulation panel comprises an enclosing member for controlling permeation of the open air, a core member defining a shape and having thermal insulating properties and contained in said enclosing member, and a non-evaporating getter contained in said enclosing member, said non-evaporating getter being of a powdery form having powders, each of which is covered with a coat layer of a water adsorbent.

6. A heat insulating thin box-like member in accordance with claim 5, wherein said non-evaporating getter is an alloy containing barium and lithium.

* * * * *